United States Patent [19]

Pentti

[11] 4,049,850

[45] Sept. 20, 1977

[54] METHOD OF CURING PLASTIC RAW MATERIALS IMPREGNATED IN A POROUS STUFF SUCH AS WOOD

[75] Inventor: Heikki Pentti, Kemi, Finland

[73] Assignee: Kemi Oy, Kemi, Finland

[21] Appl. No.: 579,554

[22] Filed: May 21, 1975

[30] Foreign Application Priority Data

May 24, 1974 Finland ..... 741596

[51] Int. Cl.[2] ..... B05D 3/02; B05D 1/18

[52] U.S. Cl. ..... 427/377; 427/393; 427/440

[58] Field of Search ..... 427/297, 393, 377, 440

[56] References Cited

U.S. PATENT DOCUMENTS

| | | | |
|---|---|---|---|
| 2,591,768 | 4/1952 | Austin | 427/297 |
| 2,740,728 | 4/1956 | Sonnabond et al. | 427/297 X |
| 2,947,648 | 8/1960 | Sonnabond et al. | 427/297 X |
| 3,476,581 | 11/1969 | Weitzel et al. | 427/377 X |
| 3,765,934 | 10/1973 | Gaylord | 427/297 |
| 3,779,797 | 12/1973 | Makinen | 427/297 |
| 3,967,011 | 6/1976 | Dunn et al. | 427/377 X |

*Primary Examiner*—Michael R. Lusignan
*Attorney, Agent, or Firm*—Kurt Kelman

[57] ABSTRACT

Wood is impregnated with a resin forming liquid, the impregnated wood is placed into a pressure vessel, and a medium of high heat capacity, such as steam, is introduced into the pressure vessel. The medium is heated above its boiling point to start curing the resin forming liquid, the heated medium cooling down at least to its phase transition temperaure as it delivers heat, and interrupting the introduction of the medium into the vessel whereby the medium is condensed on the surfaces of the impregnated wood and functions as a coolant.

8 Claims, No Drawings

METHOD OF CURING PLASTIC RAW MATERIALS IMPREGNATED IN A POROUS STUFF SUCH AS WOOD

BACKGROUND OF THE INVENTION

The present invention relates to a method of curing a synthetic resin impregnant in a porous cellulosic material, such as wood, by means of a heated curing medium in the presence or absence of a curing catalyst.

Curing of synthetic resin impregnants in wood by means of heat is conventional. The curing temperature depends primarily on the catalyst used. The curing reaction is exothermic and, if the impregnated body is not very thin, the temperature in the interior thereof often rises during the reaction to the point where the interior surfaces are scorched and the material may even split. Attempts have been made to avoid this, for instance by carrying out the polymerization of the synthetic resin impregnant in presses whose working surfaces serves to carry the heat of reaction to and from the material. One disadvantage of using presses is that the procedure can be carried out in practice only in the case of plate-like bodies. In addition, the procurement costs of presses are high.

It has been also proposed to use gas current for heating and cooling the impregnated material but they bring about a marked volatilization of the resin forming liquid impregnant, and particularly from the surface of the impregnated body, resulting in a poor surface quality. The transfer of heat into the impregnated material is slow so that a long heating time is required. In addition, the recovery of volatilized impregnant and cooling the gas considerably increase the cost of the process.

SUMMARY OF THE INVENTION

It is the primary object of this invention to provide a simple and cheap method of curing a synthetic resin impregnant in a porous cellulosic material quickly and in comparatively simple apparatus while eliminating the above disadvantages.

Essentially, this object is accomplished by using a medium of high specific heat for curing the impregnant.

Due to its numerous special characteristics, steam is the best suited medium for the practice of the invention.

According to the present invention, a method of subjecting a synthetic resin impregnant in a porous cellulosic material to an exothermic curing reaction comprises the steps of placing the impregnated cellulosic material into a pressure resistant vessel, introducing a medium of high specific heat, such as steam, into the vessel, and heating the impregnated material with the medium above the boiling point or phase transition temperature thereof to initiate the curing reaction, i.e. a temperature sufficient to accomplish polymerization of the impregnant in the material, particularly in the presence of a catalyst. The medium cools down to the phase transition temperature thereof or lower as it delivers heat to the reaction to produce a condensate of the medium, i.e. water. After the reaction has been initiated, introducing of further medium is interrupted whereby the condensate on the surface of the impregnated material functions as a coolant which effectively binds the reaction heat of the exothermic curing reaction and preventing overheating during heating above the transition temperature. The condensate vaporizes again by the heat of the reaction.

The reaction time is shorter than in known curing methods. The pressure of the medium may be atmospheric or a few atmospheres, depending primarily on the vapor pressure of the impregnant components under the reaction conditions, and must be higher than the latter pressure.

The method requires no special apparatus and may be carried out in a pressure resistant impregnation tank. It is extremely important that no appreciable volatilization or dissolving of the monomeric impregnant components occur, particularly when using steam under pressure, to maintain the synthetic resin content of the material substantially unchanged and to obtain a finished product with a surface of good quality.

The material subjected to the curing method of this invention requires no after working, and due to the effective cooling, no warping or splitting of the material appears. Even bodies of complex configuration will retain their dimensions.

The use of steam provides a very safe process involving no danger of explosion or fire. The space requirement is small.

DESCRIPTION OF THE PREFERRED EMBODIMENTS

The following example will further illustrate the practice of the invention.

Pine and birch boards 90 cm long and 6, 12 and 25 mm thick were impregnated in vacuo and under pressure with an impregnant mixture consisting of 57% polyester and 43% sytrene, and containing benzoyl peroxide as a curing catalyst. After excess impregnant solution had run off from the surface of the boards, they were placed into a pressure resistant vessel in such a way that they did not contact each other. Holes were bored into some of the boards and thermocouples were placed in the holes to follow the polymerization reaction.

After closing the cover of the vessel, steam under a pressure of four atmospheres was introduced into the closed vessel. Since part of the steam was condensed on the board surfaces and the walls of the vessel, about ten minutes passed before the steam pressure in the vessel rose to four atmospheres. When steam was introduced into the closed vessel for ten minutes, the temperature inside the impregnated boards had risen to 70° to 80° C, at which point polymerization started. Ten minutes later, the temperature was 100° C. Fifteen minutes after the pressure in the vessel had reached four atmospheres, introduction of further steam into the vessel was interrupted. Half an hour after the pressure in the vessel had risen to four atmospheres, the cover was taken off the vessel and the boards were taken out. The interior temperature of the birch boards was then 125° C and that of the pine boards was 110° C.

When the impregnant solution was kept in a glass vessel and steam was introduced therein, the temperature of the solution reached 76° C after 8 minutes when polymerization was initiated. After another 2 minutes, the temperature reached 245° C when polymerization ended and the temperature began to drop.

The surfaces of the boards removed from the pressure resistant vessel were clean and the synthetic resin impregnant was uniformly cured through the boards, no monomer having been volatilized during the curing. The boards showed no splits.

1. A method of subjecting a synthetic resin impregnant in a porous cellulosic material to an exothermic curing reaction, comprising the steps of placing the impregnated cellulosic material into a vessel, introducing a medium of high specific heat into the vessel, heating the impregnated material with the medium above the boiling point thereof to initiate the curing reaction, the medium cooling down to at least the phase transition temperature thereof as it delivers heat to the reaction to produce a condensate of the medium, and interrupting the introduction of the medium to the vessel after the reaction has been initiated whereby the condensate on the surface of the impregnated material functions as a coolant effectively binding the reaction heat of the exothermic curing reaction and preventing overheating during heating above the phase transition temperature.

2. The curing method of claim 1, wherein the cellulosic material is wood.

3. The curing method of claim 1, wherein the medium is steam.

4. The curing method of claim 1, further comprising the step of adjusting the phase transition temperature by changing the pressure in the vessel.

5. The curing method of claim 1, wherein the medium is heated to a temperature near the phase transition temperature.

6. The curing method of claim 1, wherein the pressure in the vessel is atmospheric.

7. The curing method of claim 1, wherein the pressure in the vessel is superatmospheric.

8. The curing method of claim 1, wherein the pressure in the vessel is kept higher than the vapor pressure of the synthetic resin impregnant.

* * * * *